US008684424B2

(12) United States Patent
Wattebled et al.

(10) Patent No.: US 8,684,424 B2
(45) Date of Patent: Apr. 1, 2014

(54) CLOSING ASSISTED ELECTRIC LOCK FOR OPENING OF AUTOMOBILE

(75) Inventors: Christian Wattebled, Créteil Cedex (FR); Jean-Christophe Pecoul, Créteil Cedex (FR)

(73) Assignee: Valeo Securite Habitacle, Creteil (FR)

( * ) Notice: Subject to any disclaimer, the term of this patent is extended or adjusted under 35 U.S.C. 154(b) by 222 days.

(21) Appl. No.: 12/600,777

(22) PCT Filed: May 28, 2008

(86) PCT No.: PCT/EP2008/056534

§ 371 (c)(1),
(2), (4) Date: Nov. 20, 2009

(87) PCT Pub. No.: WO2008/145668

PCT Pub. Date: Dec. 4, 2008

(65) Prior Publication Data

US 2010/0170308 A1 Jul. 8, 2010

(30) Foreign Application Priority Data

Jun. 1, 2007 (FR) ..... 07 03906

(51) Int. Cl.
*E05C 3/16* (2006.01)

(52) U.S. Cl.
USPC ..... 292/216; 292/201; 292/DIG. 23

(58) Field of Classification Search
CPC ..... E05B 83/16; E05B 53/003; E05B 85/26
USPC ..... 292/194, 214, 215, 216, 217, 201, 292/DIG. 23
See application file for complete search history.

(56) References Cited

U.S. PATENT DOCUMENTS 5,765,884 A * 6/1998 Armbruster ..... 292/216
5,934,717 A * 8/1999 Wirths et al. ..... 292/201

(Continued)

FOREIGN PATENT DOCUMENTS

DE 29 06 860 A1 9/1980
DE 197 00 887 A1 7/1998

(Continued)

OTHER PUBLICATIONS

International Search Report w/translation from PCT/EP2008/056534 dated Jul. 17, 2008 (6 pages).

(Continued)

*Primary Examiner* — Kristina Fulton
*Assistant Examiner* — Nathan Cumar
(74) *Attorney, Agent, or Firm* — Osha Liang LLP

(57) ABSTRACT

The invention relates to a closing assisted electric lock for the opening of an automobile, that comprises: a bolt (5) including first (19) and second (20) notches, said bolt (5) interacting with a strike and being capable of rotating between an open position, a position closed at the first notch of the lock and a position closed at the second notch of the lock; a pivoting ratchet (13) capable of interacting with said bolt (5) for preventing the rotation thereof (5) into a closed position at the first and second notches of the lock; a bolt (5) driving lever for rotatingly driving the bolt (5) between the closed position at the first notch and the closed position at the second notch of the lock; characterized in that the driving lever (9) includes a protrusion (37) provided so that said bolt (5) is capable of pivoting the lever (9) when said bolt (5) rotates from the open position to the closed position at the second notch of the lock.

7 Claims, 2 Drawing Sheets

(56) References Cited

U.S. PATENT DOCUMENTS

Figure 3:
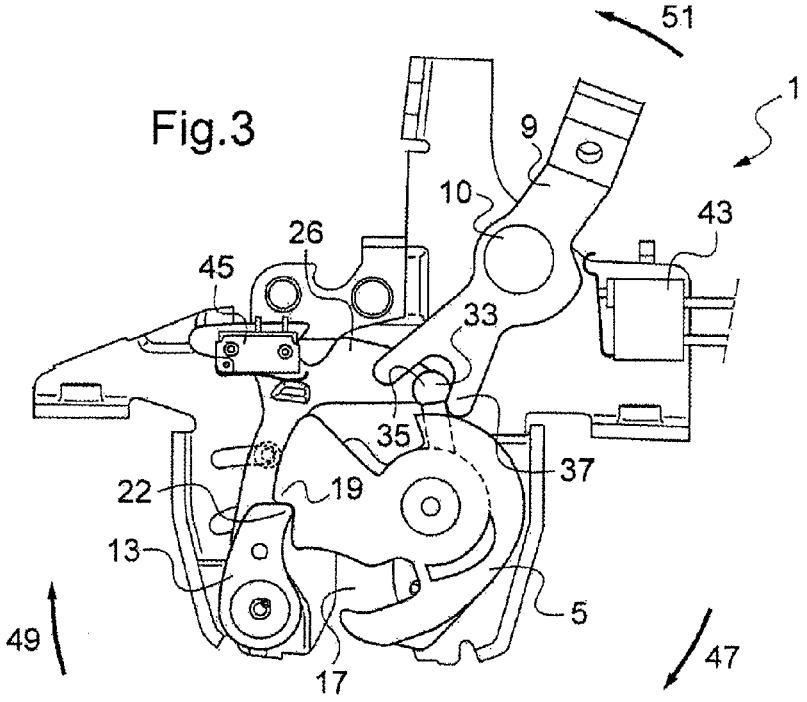

| | | | | | |
|---|---|---|---|---|---|
| 5,992,194 | A | * | 11/1999 | Baukholt et al. | 70/279.1 |
| 6,056,334 | A | * | 5/2000 | Petzold et al. | 292/216 |
| 6,116,664 | A | * | 9/2000 | Wegner | 292/216 |
| 6,386,599 | B1 | * | 5/2002 | Chevalier | 292/201 |
| 6,435,573 | B1 | * | 8/2002 | Szablewski | 292/201 |
| 6,705,649 | B1 | * | 3/2004 | Reddmann | 292/216 |
| 2004/0227357 | A1 | * | 11/2004 | Ishihara et al. | 292/216 |

FOREIGN PATENT DOCUMENTS

| | | | | | |
|---|---|---|---|---|---|
| DE | 199 05 774 | | * | 12/1999 | E05B 65/12 |
| DE | 199 05 774 | A1 | | 8/2000 | |
| EP | 0 038 226 | A1 | | 10/1981 | |
| EP | 0 133 508 | A1 | | 2/1985 | |
| EP | 1 452 361 | A2 | | 9/2004 | |
| JP | 1-119761 | | | 5/1989 | |
| JP | H05-156856 | A | | 6/1993 | |

OTHER PUBLICATIONS

Written Opinion from PCT/EP2008/056534 dated Jul. 17, 2008 (6 pages).

Japanese Office Action in corresponding Japanese Application No. 2010-509813 dated Dec. 25, 2012 (3 pages).

Patent Abstracts of Japan forJapanese publication No. 01-119761, dated May 11, 1989.

Office Action in corresponding Japanese Patent Application No. 2010-509813 dated Oct. 18, 2013, with translation (9 pages).

Espacenet Publication Abstract for H05-156856, publication date Jun. 22, 1993 (2 pages).

* cited by examiner

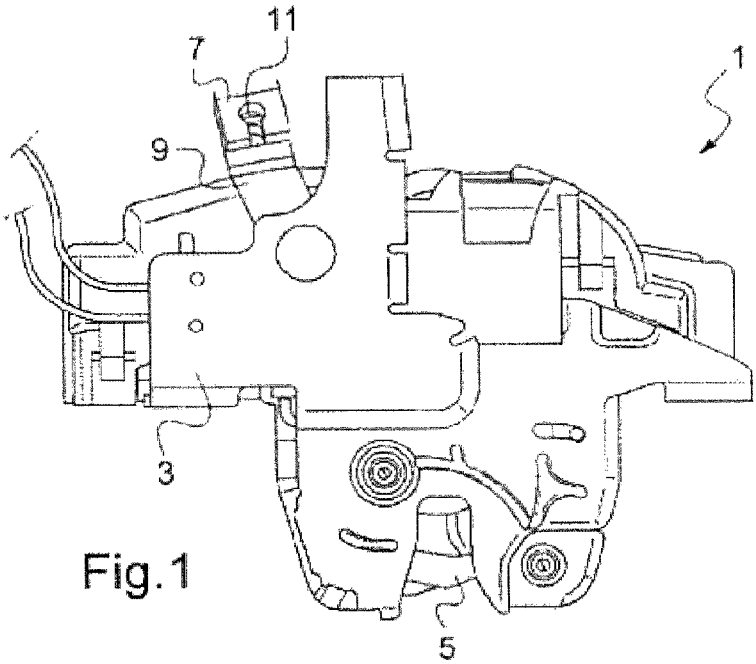
Fig.1
Fig.2
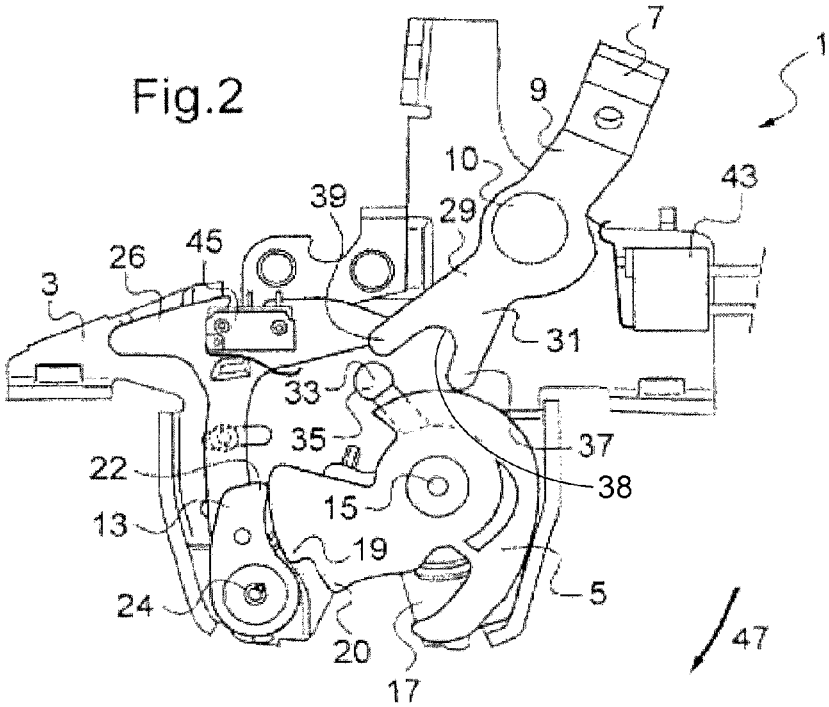

CLOSING ASSISTED ELECTRIC LOCK FOR OPENING OF AUTOMOBILE

The present invention relates to a motorized closing-aid electric lock for an opening element of a motor vehicle, particularly for a door, a tailgate, a tailgate window or the trunk of a motor vehicle.

Conventional motorized closing-aid electric locks comprise a bolt with two closure catches, designed to interact with a strike.

In the process of assisted electric closure of a motor vehicle opening element, the bolt is rotated in order to ensure, once engaged with the strike, the closure of the opening element and the compression of the seal between the opening element and the bodywork.

In order to operate the bolt from the closed position at the first catch to the closed position at the second catch, the locks also comprise an operating lever, that can be engaged with the bolt, pivoted by an electric actuator that can be separate from the lock.

In the open position of the lock, the operating lever is disengaged from the bolt in order to make it possible, in particular, to retain the operation of the lock in the event of an electric fault, for example of the actuator.

When the lock is opened, the bolt is made to pivot by the strike or by the reaction force of the seal.

This pivoting rotates the operating lever in the opposite direction of rotation.

These motorized closing-aid mechanisms may however form a source of not inconsiderable noise for the user.

Moreover, to ensure correct operation of the mechanism, it is also necessary to ensure that the opening element is closed in a relatively short time.

The object of the present invention is to remedy these problems by proposing an enhanced electric lock the closing-aid mechanism of which is improved, particularly by the optimization of the time necessary to close the opening element.

Accordingly, the invention proposes a closing-aid electric lock for an opening element of a motor vehicle comprising:

- a bolt comprising a first catch and a second catch, said bolt being designed to interact with a strike and being capable of rotating between an open position, a closed position at the first catch and a closed position at the second catch of the lock,
- a pivoting pawl capable of interacting with said bolt in order to prevent a rotation of said bolt in the closed position at the first and at the second catch of the lock,
- a lever for operating said bolt in order to rotate said bolt between the closed position at the first catch and the closed position at the second catch of the lock, characterized in that the operating lever comprises a protuberance arranged so that said bolt is capable of causing said lever to pivot when said bolt turns from the open position to the closed position at the first catch of the lock.

Figure 4:
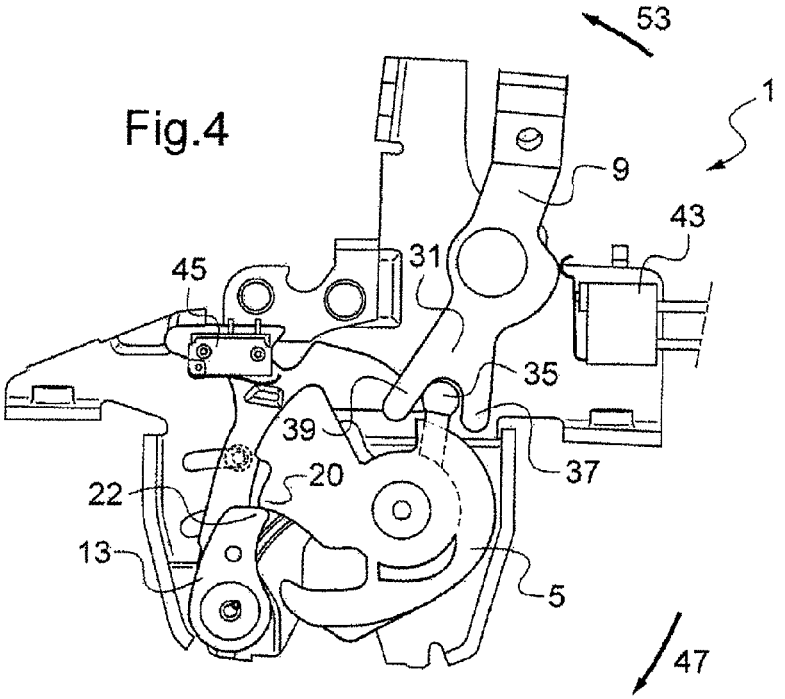

Other advantages and features will appear on reading the description of the invention and the following figures in which:

FIG. 1 is a side view of the lock according to the invention in the closed position, FIG. 2 is an internal view of the opposite side of the lock of FIG. 1 in the open position, FIG. 3 is a view similar to FIG. 2, in the closed position at the first catch of the lock, FIG. 4 is a view similar to FIG. 3, in the closed position at the second catch of the lock.

In all the figures, identical elements bear the same reference numbers.

FIG. 1 represents a motorized closing-aid electric lock 1 according to the invention for an opening element of a motor vehicle, particularly for a door, a tailgate, a tailgate window or the trunk of a motor vehicle.

The lock 1 comprises a casing 3 containing a rotating bolt 5 designed to interact with a strike (not shown).

In order to operate the bolt 5 from the closed position at the first catch to the closed position at the second catch, the lock comprises an operating lever 9, that can be engaged with the bolt 5, pivoted by an electric actuator.

Since the space available in the lock 1 is very limited, provision is made to separate the actuator by using a drive cable in order to form a functional lock-actuator assembly.

Therefore, shown in FIG. 1 is a first arm 7 of the operating lever 9 comprising an orifice 11 to connect the lever 9 to the drive cable of the electric actuator (not shown).

FIG. 2 shows the inside of the casing 3 of the lock 1 comprising the bolt 5, a pawl 13 and the operating lever 9.

The bolt 5, capable of rotating about the rotation shaft 15, has a housing 17 designed to receive the strike which interacts with the lock 1.

The bolt 5 has two safety catches 19 and 20 defining two closed positions of an opening element.

The two catches 19 and 20 are designed to interact with a beak-shaped end 22 of the pawl 13 to prevent the bolt 5 from rotating.

The pawl 13 is subjected to an elastic return force which pushes it toward the bolt 5.

The pawl 13 is designed to be secured pivotingly to a driver 26 itself operated by an actuator for opening the lock (not shown).

The driver 26 is capable of pivoting with the pawl 13 about a rotation shaft 24.

Therefore, the bolt 5 can pivot between an open position (FIG. 2), a closed position at the first catch (FIG. 3) and a closed position at the second catch (FIG. 4) of the lock 1.

In the closed position at the first catch shown in FIG. 3, the pawl 13 rests via its end beak 22 against the first catch 19. In this way, the strike is trapped in the housing 17 which holds the door in the closed state.

Then, in the closed position at the second catch, shown in FIG. 4, the end beak 22 of the pawl 13 rests against the second catch 20 of the bolt 5.

According to the invention, the operating lever 9 comprises a protuberance 38 arranged so that the bolt 5 is capable of causing the lever 9 to pivot when the bolt 5 turns from the open position to the closed position at the first catch of the lock.

The pivoting of the lever 9 allows it to engage with the bolt in order to operate it to the closed position at the second catch.

For this, and as is shown in FIG. 2, the lever 9 comprises a second arm 29 supporting the protuberance 37, designed to interact with an actuation member 33 secured in rotation to the bolt 5.

The lever 9 is therefore articulated about a rotation shaft 10.

An elastic return force pushes it into a disengaged position away from the bolt 5 in the open position of the lock.

Advantageously, the protuberance 38 is formed in a first branch which forms a fork 31 with a second branch 39, at the free end of the second arm 29 of the lever.

Preferably, the fork 31 is capable of interacting with an associated excrescence supported by the actuation member 33.

Therefore, the first branch 37 is capable of being pivoted by the bolt 5 when the bolt 5 turns from the open position to the closed position at the first catch of the lock.

Moreover, the second branch 39 is capable of rotating the excrescence 35 of the bolt 5 between the closed position at the first catch and the closed position at the second catch of the lock.

According to a particular embodiment of the invention, the lock 1 comprises a first position sensor 43 for determining the closed position at the second catch of the lock.

Advantageously, the first sensor 43 is placed at the operating lever 9, so as to be activated when the operating lever 9 pivots.

Therefore, the sensor 43 is activated when the lever 9 has pivoted from the closed position at the first catch to the closed position at the second catch of the lock 1.

A second position sensor 45 of the lock 1 capable of determining an active position of retention of the bolt 5 by the pawl 13 is placed at the driver 26 of the pawl 13.

This sensor 45 is activated when the pawl 13 is in the active position of retention of the bolt 5 in the closed position at the first or second catch of the lock 1.

Provision is made to connect the position sensors 43 and 45 to a processing unit (not shown), capable of controlling the driving of the bolt 5 by the operating lever 9 when the lock 1 is closed at the first catch.

Therefore, the processing unit controls the driving of the bolt 5 by the lever 9 when the second position sensor 45 of the pawl is activated and the first sensor 43 of the lever 9 is deactivated.

The operation is stopped when the two sensors 43 and 45 are activated.

Starting from the initial open position of the opening element of FIG. 2, and now considering FIGS. 3 to 4, the operation of the electric lock will now be described.

In the initial open position, the position sensors 43 and 45 are deactivated.

The closure of the opening element at the first catch of FIG. 3 is provided by the rotation of the bolt 5 in the clockwise direction as schematized by the arrow 47.

The actuation member 33, secured in rotation to the bolt 5, also turns in the clockwise direction indicated by the arrow 47.

The pawl 13 and the pawl driver 26, forced elastically against the bolt 5, pivot in the clockwise direction, as represented by the arrow 49 in FIG. 3.

During the rotation of the bolt 5, the first branch 37 of the lever 9 comes into contact with the excrescence 35 of the actuation member 33.

Then the excrescence 35 operates the lever 9 in the counterclockwise direction to its position engaged with the bolt 5, as schematized by the arrow 51, placing the lever 9 in the effective path of the actuator of the lever 9.

Therefore, the movement of the actuator is capable of immediately causing the movement of the operating lever 9, with no free travel and therefore no wastage of time.

When the bolt 5 has finished pivoting in the closed position at the first catch, the end of the hook 22 of the pawl 13 rests on the first catch 19 of the bolt 5, preventing the bolt 5 from turning in the counterclockwise direction of rotation.

Therefore, the opening of the opening element is blocked by the closure of the lock at the first catch.

The first position sensor 43 is still deactivated while the second position sensor 45 for retaining the bolt 5 is activated.

The processing unit then controls the operating lever 9, via the separate electric actuator, in the counterclockwise direction, as schematized by the arrow 53 in FIG. 4.

The second branch 39 of the fork 31 then rapidly comes into contact with the excrescence 35 of the bolt 5 in order to rotate it in the clockwise direction of the arrow 47 to the closed position at the second catch of the lock 1.

When the bolt 5 has finished pivoting in the closed position at the second catch, the end of the hook 22 of the pawl 13 rests on the second catch 20 of the bolt 5.

The first sensor 43 of the closed position at the second catch of the lock is then activated and the processing unit stops the operation of the bolt 5 by the lever 9.

Therefore, the bolt 5 can no longer turn in the counterclockwise direction of rotation, which closes the lock 1 at the second catch.

When the user opens the lock 1, the rotation of the bolt 5 caused by the strike or by the reaction force of the elastic seal operates the lever 9 in the opposite direction of rotation.

The operation is provided by the action of the excrescence 35 on the second branch 39 until the lever escapes from the excrescence 35, thus returning to the disengaged position of the bolt 5.

The lever 9 is then tilted into the initial position illustrated in FIG. 2 away from the bolt 5 by the elastic return force.

The present invention therefore makes it possible to optimize the time necessary to close the opening element.

Specifically, the operation of the lever 9 by the bolt 5, when the latter turns to the closed position at the first catch, has the effect of prepositioning the lever in the active position, reducing the travel of the lever 9.

Therefore the lever 9 is capable of operating the bolt 5 as soon as the bolt 5 reaches the closed position at the first catch, without wasting time due to the travel of the lever 9 to its engaged position.

Reducing the actuation time also has the effect of reducing the duration of motorization of the actuator, reducing the noise generated by the latter.

Moreover, this mechanism is simple to produce and takes up little space, which makes it possible to free up the space in the casing 3 of the lock 1, allowing the integration of the position sensors in order to automate the assisted closure function at the second catch.

It is understood that, with a motorized closing-aid electric lock 1 comprising a protuberance 38 of the operating lever 9 arranged to pivot the lever 9 to its engaged position with the bolt 5 when the bolt 5 turns from the open position to the closed position at the first catch of the lock 1, it is possible to optimize the time necessary for the closure of the opening element by an effective prepositioning of the operating lever 9.

The invention claimed is:

1. A closing-aid electric lock for an opening element of a motor vehicle comprising:

a bolt comprising a first catch and a second catch, wherein the bolt interacts with a strike and rotates between an open position, a closed position at the first catch, and a closed position at the second catch of the lock;

a pivoting pawl that interacts with said bolt in order to prevent a rotation of said bolt in the closed position at the first and at the second catch of the lock; and a lever for operating said bolt in order to rotate said bolt between the closed position at the first catch and the closed position at the second catch of the lock, wherein said lever comprises a first arm configured to connect to an electric actuator, and a second arm supporting a protuberance and for interacting with an actuation member secured in rotation to said bolt, wherein the protuberance is formed in a first branch forming a fork with a second branch at the free end of the second arm of said lever, and wherein the actuation member comprises an excrescence that interacts with the fork, wherein the fork is arranged so that said excrescence causes said lever to pivot when said bolt turns from the open position to the closed position at the first catch of the lock in order to operate the lever in a position engaged with the bolt, placing the lever in the effective path of the actuator of the lever, wherein the first branch of the fork is pivoted by the excrescence when the bolt turns from the open position to the closed position at the first catch of the lock, wherein the second branch of the fork rotates the excrescence between the closed position at the first catch and the closed position at the second catch of the lock, and wherein the lever for operating said bolt is disengaged from the bolt when the lock is in the open position.

2. The lock as claimed in claim 1, further comprising: a first position sensor capable of determining the closed position at the second catch of the lock.

3. The lock as claimed in claim 2, wherein said first sensor is placed at the operating lever, so as to be activated when the operating lever has pivoted from the closed position at the first catch to the closed position at the second catch of the lock.

4. The lock as claimed in claim 3, further comprising: a second position sensor capable of determining an active position of retention of said bolt by said pawl.

5. The lock as claimed in claim 4, wherein said second sensor is placed at a driver of said pawl so as to be activated when said pawl is in the active position of retention of said bolt.

6. The lock as claimed in claim 5, wherein the first and second position sensors are connected to a processing unit, capable of controlling the driving of said bolt by the operating lever when the second position sensor of the pawl is activated and the first sensor of said lever is deactivated, until said first sensor is also activated.

7. A functional lock-actuator assembly comprising: a lock as claimed in claim 1 and the electric actuator connected to said lever via a drive cable.

* * * * *